US011295595B2

(12) United States Patent
Murray

(10) Patent No.: US 11,295,595 B2
(45) Date of Patent: Apr. 5, 2022

(54) EMERGENCY ALERT SYSTEM

(71) Applicant: Inventis Technology Pty Limited, Eastern Creek (AU)

(72) Inventor: Joel Stephen Murray, Coniston (AU)

(73) Assignee: Inventis Technology Pty Limited, Eastern Creek (AU)

( * ) Notice: Subject to any disclaimer, the term of this patent is extended or adjusted under 35 U.S.C. 154(b) by 0 days.

(21) Appl. No.: 17/124,815

(22) Filed: Dec. 17, 2020

(65) Prior Publication Data

US 2021/0192916 A1 Jun. 24, 2021

(30) Foreign Application Priority Data

Dec. 20, 2019 (AU) ..... 2019904844

(51) Int. Cl.
*G08B 21/02* (2006.01)
*G08B 21/04* (2006.01)
*G08B 7/06* (2006.01)

(52) U.S. Cl.
CPC ..... *G08B 21/0269* (2013.01); *G08B 7/06* (2013.01); *G08B 21/0272* (2013.01); *G08B 21/0294* (2013.01); *G08B 21/0415* (2013.01)

(58) Field of Classification Search
CPC ..... G08B 21/0269
See application file for complete search history.

(56) References Cited

U.S. PATENT DOCUMENTS 6,624,754 B1 * 9/2003 Hoffman ..... G08B 21/023 340/573.1
2014/0077946 A1 * 3/2014 Tran ..... A61B 5/681 340/539.13
2014/0333432 A1 * 11/2014 Armitage ..... G08B 25/016 340/539.11
2019/0228631 A1 * 7/2019 Stinson ..... G06Q 10/06

* cited by examiner

*Primary Examiner* — Travis R Hunnings
(74) *Attorney, Agent, or Firm* — Patterson Thuente Pedersen, P.A.

(57) ABSTRACT

An emergency alert system is described. The emergency alert system comprises at least one alert device; a control module connected to the alert device for managing the emergency alert system 5 through radio frequency communications over a radio link; and a portable remote-control unit for sending a signal to the control module, via the radio link, upon a user activating the remote-control unit to trigger an emergency alert using the alert device, wherein the control module is used to determine a physical location of the portable remote-control unit via the radio link in the event of the emergency alert being triggered.

21 Claims, 7 Drawing Sheets

EMERGENCY ALERT SYSTEM

CROSS-REFERENCE TO RELATED APPLICATION

This application claims priority from Australian Provisional Patent Application No. 2019904844, filed 20 Dec. 2019, hereby incorporated by reference in its entirety as if fully set forth herein.

TECHNICAL FIELD

The present invention relates generally to emergency alerts and, in particular, to a system for providing an emergency alert. The present invention also relates to a computer readable medium having recorded thereon a computer program for providing an emergency alert.

BACKGROUND

The use of personal address (PA) systems in premises or workplaces, such as schools, military bases and industrial yards, is known. PA systems have conventionally been used for delivering emergency alerts such as lockdown, evacuation and all clear signals in incidents including school/military invasions, fires, etc. The use of audio visual alert devices such as sirens and flashing light alert devices for delivering emergency alerts is also known.

Conventional PA systems, sirens and flashing light systems are typically hard wired into premises and workplaces. Alerts may be triggered by outputs from a fire/alarm control panel (e.g., linked to fire detection alarms). The alerts may include audio file recordings which can be sirens, voice or music. A siren tone followed by a voice instruction may be used (e.g., "w000p w000p w000p, Evacuate, go to your evacuation assembly area").

More recently wireless emergency alert systems have been used for providing emergency alerts. Some wireless emergency alert systems may be triggered by a portable remote-control unit, which can be handheld or wall mounted. However, even when activated, such emergency alert systems provide no indication of the location of an emergency on a site and often the portable remote-control unit is not able to be located.

SUMMARY

It is an object of the present invention to substantially overcome, or at least ameliorate, one or more disadvantages of existing arrangements.

In one aspect of the present disclosure, there is provided an emergency alert system comprising:

at least one alert device;

a control module connected to the alert device for managing the emergency alert system through radio frequency communications over a radio link; and a portable remote-control unit for 5 sending a signal to the control module, via the radio link, upon a user activating the remote-control unit to trigger an emergency alert using the alert device, wherein the control module is used to determine a physical location of the portable remote-control unit via the radio link in the event of the emergency alert being triggered.

The physical location of the remote-control unit may be indicated on a user interface displayed on a device connected to the radio link. The location of the remote-control unit may also be tracked live.

The emergency alert system may trigger an alert in the absence of physical movement of the remote-control unit for a predetermined period. The emergency alert system may also trigger an alert in the absence of a user selection on the remote-control unit for a predetermined period.

The control module may be configured for paging the remote-control unit.

The emergency alert system may interface with the Internet to allow remote monitoring.

The location of the remote-control unit may be determined independent of a Global Navigation Satellite System (GNSS) or similar system (GPS, GLONASS).

Radio signal strength may be used to determine the location of the remote-control unit based on triangulation.

The emergency alert system may comprise one or more strobe lights for providing a visual alert. The emergency alert system may also comprise one or more repeaters for routing network data from the remote-control unit to control module via the radio link.

The alert device may be a speaker and/or a siren. In one arrangement, the alert device is an audio-visual device including both a speaker and some form of visual alert (e.g., strobe light).

Additional aspects and advantages will be apparent upon consideration of the ensuing drawings and description.

DETAILED DESCRIPTION OF THE DRAWINGS

It is to be noted that the discussions contained in the "Background" section and that above relating to prior art arrangements relate to discussions of documents or devices which form public knowledge through their respective publication and/or use. Such should not be interpreted as a representation by the present inventor(s) or patent applicant that such documents or devices in any way form part of the common general knowledge in the art.

In the following description, certain specific details are set forth in order to provide a thorough understanding of various disclosed embodiments. However, one skilled in the relevant art will recognize that embodiments may be practised without one or more of these specific details, or with other methods, components, materials, etc.

Elements appearing in more than one figure and with the same reference number are intended to represent the identical type or instance, depending on context, unless otherwise noted in the text.

An emergency alert system 100 (see FIG. 1) having 'location awareness' is described below. A portable remote-control unit 103 of the system 100 is configured to allow the physical location of the portable remote-control unit 103 to be determined upon an emergency alert being triggered.

In conventional emergency alert systems including portable remote-control units that do not have location awareness, an alarm (e.g., an audio alert) can only indicate that someone on a particular site (e.g., a school) has triggered the alarm, and it is very difficult or not possible, to direct assistance to the location of the person that triggered the alarm until a manual search of the site has been performed. The system 100 is configured to allow the actual location of an alert trigger to be determined so that an assistance/evacuation response is targeted to the location of the person that triggered the alert.

Figure 1:
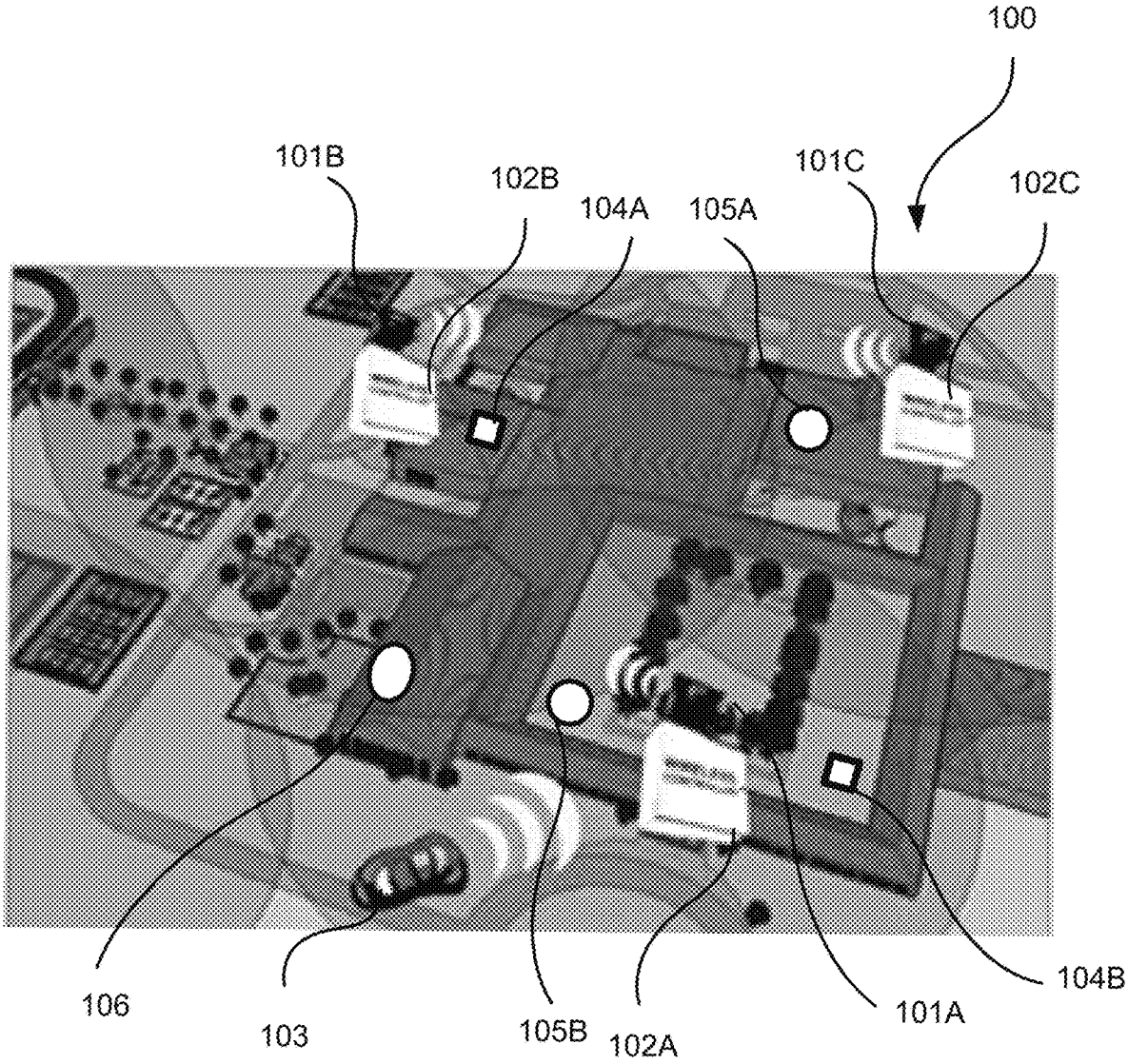
FIG. 1 is a schematic drawing of an example alert system comprising control modules and a remote-control.

FIG. 1 shows a physical site on which the emergency alert system 100 has been installed. In the example of FIG. 1, the site is a school campus. The emergency alert system 100 has a scalable architecture with a configuration that can be selected for the characteristics of the particular site. The system 100 of FIG. 1 comprises a plurality of alert devices in the form of speakers 101A to 101C where each speaker (e.g., 101A) is installed at a different location on the site. Each speaker 101A-101C is connected to a control module 102A-102C by a cable. In another arrangement, each control module 102A-102C is connected to three (3) outdoor speakers. In still another arrangement, each control module 102A-102C is connected to a plurality (e.g., thirty-six (36)) of lower volume indoor speakers, or a combination of such speakers. In one arrangement, the alert device used in the system 100 may be in the form of a siren. In still another arrangement, each control module (e.g., 102A) is connected to an audio-visual alert device (AVAD) configured for outputting both siren and strobe lights. The control modules 102A-102C may comprise a strobe light control (e.g., a 12 Volt, 1 Amp strobe light control) for controlling a strobe light (not shown) connected to the control module 102A via a cable.

Figure 2:
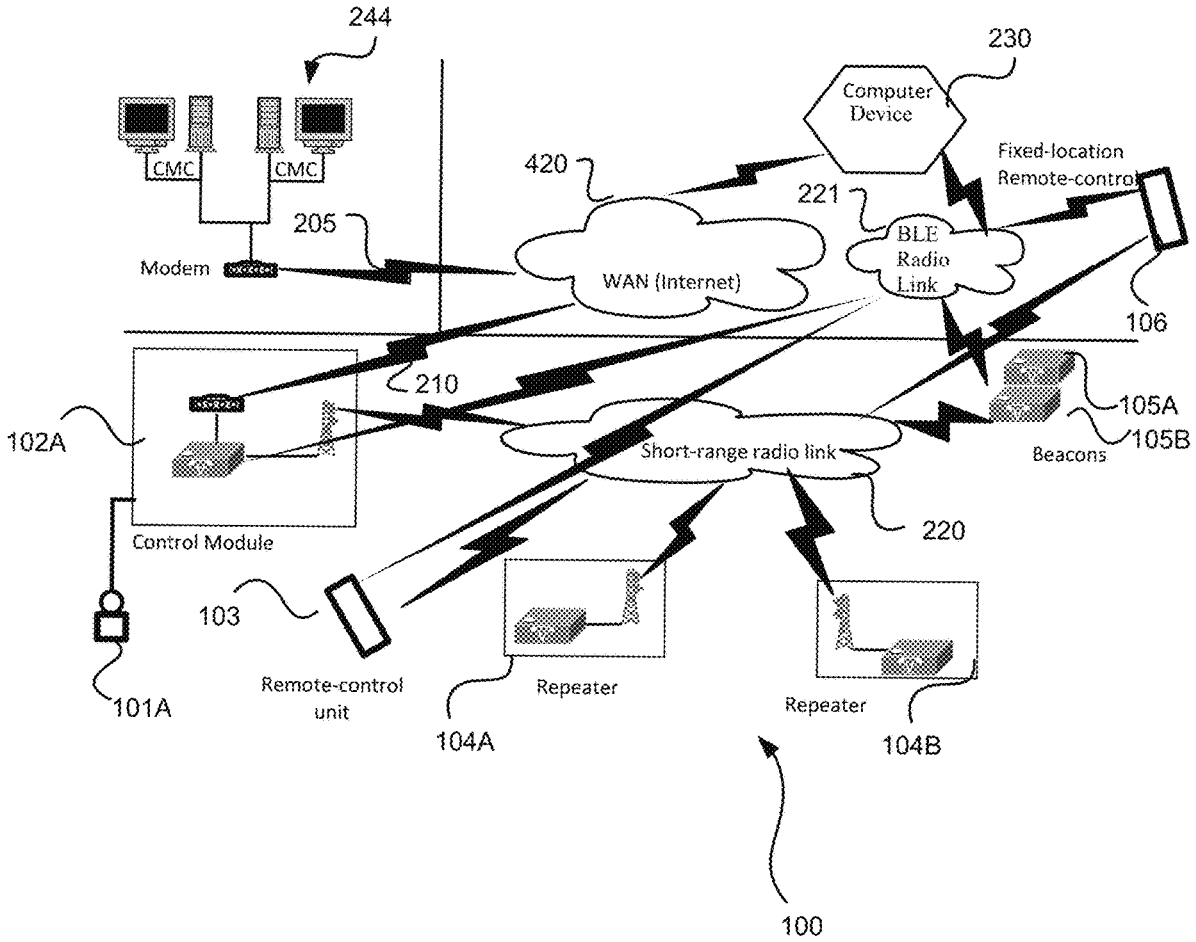
FIG. 2 is a schematic drawing of the emergency alert system of FIG. 1.

The control modules 102A-102C are computer devices comprising a radio frequency (RF) transceiver and are used to manage the emergency alert system 100 through intra-system RF communications over a short-range radio link 220 (see FIG. 2). The radio link 220 may be referred to as a primary radio network which is the main RF network 5 for operation of the system 100. RF communication may be implemented using any suitable frequency and RF spectrum rules. As an example, the RF communications of the system 100 may operate at a frequency of 433 MHz, 915 MHz or 2.45 GHz including dual band combinations.

In one arrangement, one of the control modules 102A-102C may be specified as a system control module (SCM). The system control module may function as a central management point for the system 100. For the purposes of the description below, the control module 102A will be considered as the system control module (SCM). However, any one of the control modules 102A-102C may be configured as the SCM.

Figure 3:
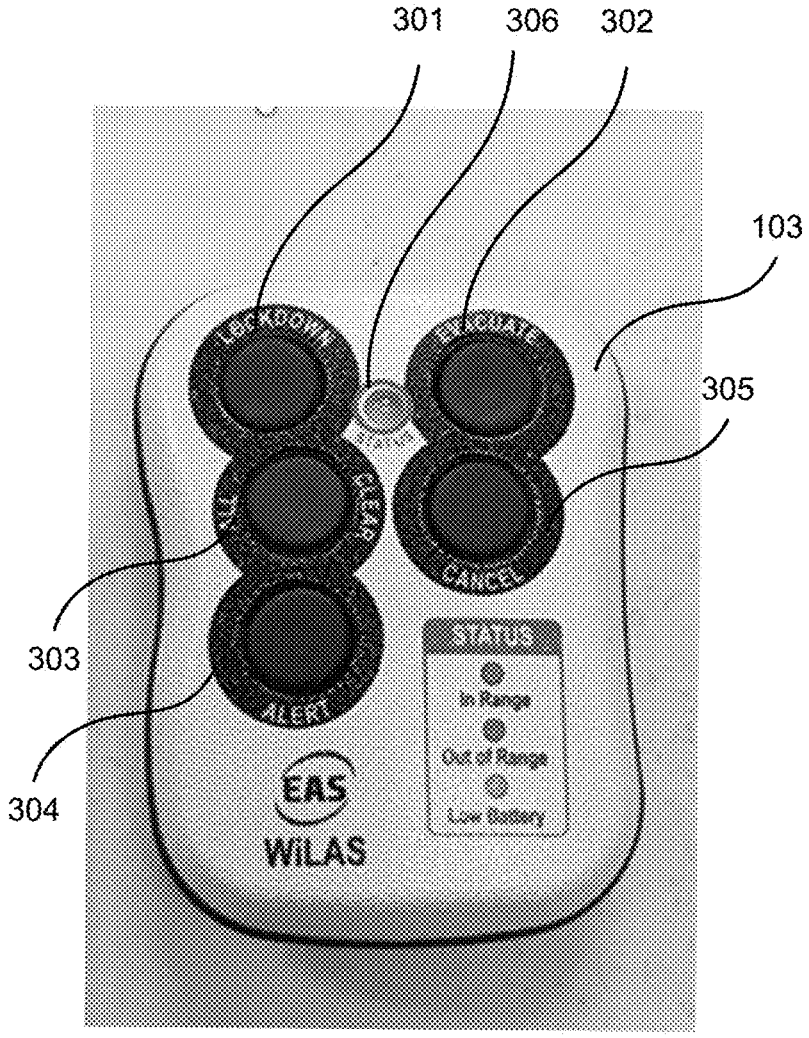
FIG. 3 shows the remote-control of the emergency alert system of FIG. 1.

The system 100 also comprises a remote-control unit 103 as seen in FIG. 3. The remote-control unit 103 is a portable handheld computer device comprising a radio transceiver. The remote-control unit 103 may be connected to a user via a lanyard, belt/pocket clip, armband. In other arrangements, the portable remote-control unit 103 may be mounted in a fixed location within a building or vehicle.

An emergency alert is triggered upon a user selecting one of the buttons 301 to 305 (see FIG. 3) on the remote-control unit 103. It will be appreciated that the remote-control unit 103 used in the system 100 may have any suitable number of buttons or configuration.

In one arrangement, alarms may also be triggered by outputs from a fire/alarm control panel located on the site (e.g., within the school). The selection of a button 301 to 305 on the remote-control unit 103 causes a signal to be sent from the remote-control unit 103 to at least one of the control modules 30 102A-102C via the radio link 220. The control module (e.g., 102A) that received the signal then causes an audio alert to be sounded on the associated siren 101A, on indoor ceiling mount speakers or on an audio-visual device connected to the control module 102A. The audio alert may comprise file recordings of a siren, voice or music. In one arrangement, a siren tone followed by a voice instruction is used to generate the alert (e.g., "wooop wooop wooop, Evacuate, go to your evacuation assembly area").

In another arrangement, upon receipt of the signal from the remote-control unit 103, the control module 102A then causes a visual alert to be generated on the strobe light, audio-visual device or the like. In still another arrangement, upon receipt of the signal from the remote-control unit 103, the control module 102A may cause a variable message sign connected to the control module 102A to display a message. In still another arrangement, the emergency alert may be triggered via wired digital inputs on the control modules 102A to 102C.

The system 100 of FIG. 1 also comprises one or more repeaters 104A-104B. The repeaters 104A-104B are computer devices comprising a radio frequency (RF) transceiver, similar to the control modules 102A-102C. The repeaters 104A-104B are used to route network data from the remote-control unit 103 to the control modules 102A-102C. The repeaters 104A to 104B increase the RF communications coverage area of the control modules 102A-102C. The repeaters 104A-104B may be referred to as a 'primary radio network device' which route network data. The number of repeaters 104A-104B per implementation of the system 100 will depend on environmental conditions such as building structures, surrounding topology, line of site, etc. The repeaters 104A-104B enable the system 100 to span large areas without the need for cabling between each module 102A-102C. As such, the system 100 is a wireless system. One of the repeaters may act as a "master repeater" which is used to synchronise the system 100 to timing of the master repeater and to act as a network central point. In one arrangement, one or more of the control modules 102A-102C may also function as a repeater.

In one arrangement, an audio-visual alert device connected to a control module (e.g., 102A) may provide repeater functionality and input/output functionality similar to the repeaters 104A-104B. Such an audio-visual alert device may also act as a master repeater through which communications need to be directed.

As described above, each of the control modules 102A-102C provide an interface between the speakers 101A to 102C and the remote-control unit 103. In one arrangement, the control modules 102A-102C also provide an interface between the system 100 and a communications network 420 (see FIG. 2) such as the Internet.

The control modules 102A-102C may also comprise an input/output module (TOM) (not shown). The IOM may have a similar configuration to a control module (e.g., 102A) but without speaker amplifier capabilities. The TOM may be used for interfacing with electrical inputs and outputs (e.g., fire control panels), for interfacing with variable message text signs, and for driving simple strobe lights. The IOM may execute in a low power battery mode which does not provide repeater functionality and which may be used for battery powered strobe lights.

Each of the control modules 102A-102C may also comprise a range extender module (REM) (not shown) which has a similar configuration to the IOM. The REM provides similar functionality to the repeaters 104A-104B. The REM may be used for providing network coverage where no alert output is needed.

The system 100 of FIG. 1 also comprises short range radio beacons 105A-105B. The beacons are small computer devices comprising a radio transceiver. Each beacon 105A-105B sends periodic radio signals ('pings') to provide a location reference to the remote-control unit 103. Each of the radio beacons 105A-105B may comprise a radio transceiver (not shown) to communicate with the remote-control unit 103 via the radio link 220.

In one arrangement, the radio beacons 105A-105B may comprise Bluetooth® functionality to connect to the remote-control unit 103. As seen in FIG. 1, a remote-control unit 106 may also be mounted at a fixed location and be configured to perform the dual function of a beacon 105A-105B. The fixed location remote-control unit 106 has a similar configuration to remote-control unit 103. However, the fixed location remote-control unit 106 may be configured to provide location functionality similar to a location beacon (e.g., 105A). In this instance, the fixed location remote-control unit 106 may be fitted with an optional Bluetooth low energy (BLE) chipset or may comprise merged packaging with a beacon device (e.g., 105A). A fixed location remote-control unit 106 configured with such location functionality does not need to poll for beacon transmissions because the remote-control unit 106 is aware of its own beacon status.

In the system 100 of FIG. 1, the control modules 102A-102C, remote-control unit 103, repeaters 104A to 104B, beacons 105A-105B, and audio-visual device are battery operated. Remote control units 103 are recharged via battery swap, charger connection or wireless charger interface. Solar power, mains regulated voltage or manual battery swaps may also be used to recharge the control modules 102A-102C and repeaters 104A to 104B, enabling the system 100 to span sites multi-kilometres across. The batteries enable the system 100 to function for long periods in the event of power failures.

The remote-control unit 103 uses low power radio communications to communicate with the control modules 102A-102C and repeaters 104A-104B via the short-range radio link 220 as shown in FIG. 2. The radio link 220 is stand-alone and is independent of cellular networks and the Internet, to enable the system 100 to operate in the event that the cellular network or Internet 420 are offline.

FIG. 2 shows the system 100 in further detail. As seen in FIG. 2, a personal computer device (e.g., a desktop, laptop or handheld tablet or smartphone) device) 230 comprising display capability may be connected to the network 220 to interface with the control modules 102A-102C or remote-control units 103, 106A. As also seen in FIG. 2, the device 230 may also interface with the control modules 102A-102C or remote-control units 103 and 106A via Bluetooth (BLE) link 221. The device 230 may be configured to execute a companion software application to display information from the control module 102A or remote-control units 103 and 106A for a user.

In FIG. 2, only one of the control modules 102A is shown for the purpose of clarity. As described above, the control module 102A may be specified as the system control module (SCM).

The control module (e.g., 102A) may be configured to receive commands from a central management centre (CMC) 244 via radio links 205 and 210 and the network 420. Further, system monitoring and diagnostics is provided through any suitable radio protocol.

The control module 102A, remote-control units 103/106A and repeater 104A may also be configured to report battery backup and recharging status, network signal strength, system status, self-test capabilities, and diagnostics (e.g., fault information) back to the CMC 244 via the network 420. The control modules 102A may be configured to translate and relay a command or data to the CMC 244 via the RF links 210 and 205. Such reporting allows for testing of the system 100 from a central control point.

The control module 102A may also be configured to report battery backup and recharging status, network signal strength, system status, self-test capabilities, and diagnostics (e.g., fault information) to the other control modules 102B-102C connected to the network 220. All repeaters 104A-104B within range of the control module 102A that received the transmissions may act on the transmissions or relay the transmissions. In one arrangement, status of the system 100 may be monitored via the companion application executing on the device 230. System status readings (e.g., recharging status of the devices connected to the link 220) may be periodically reported to the companion application by the control module 102A. Such system status readings allow health of the system 100 to be verified and diagnosed quickly without needing to visit each control module 102A-102C.

Figure 4:
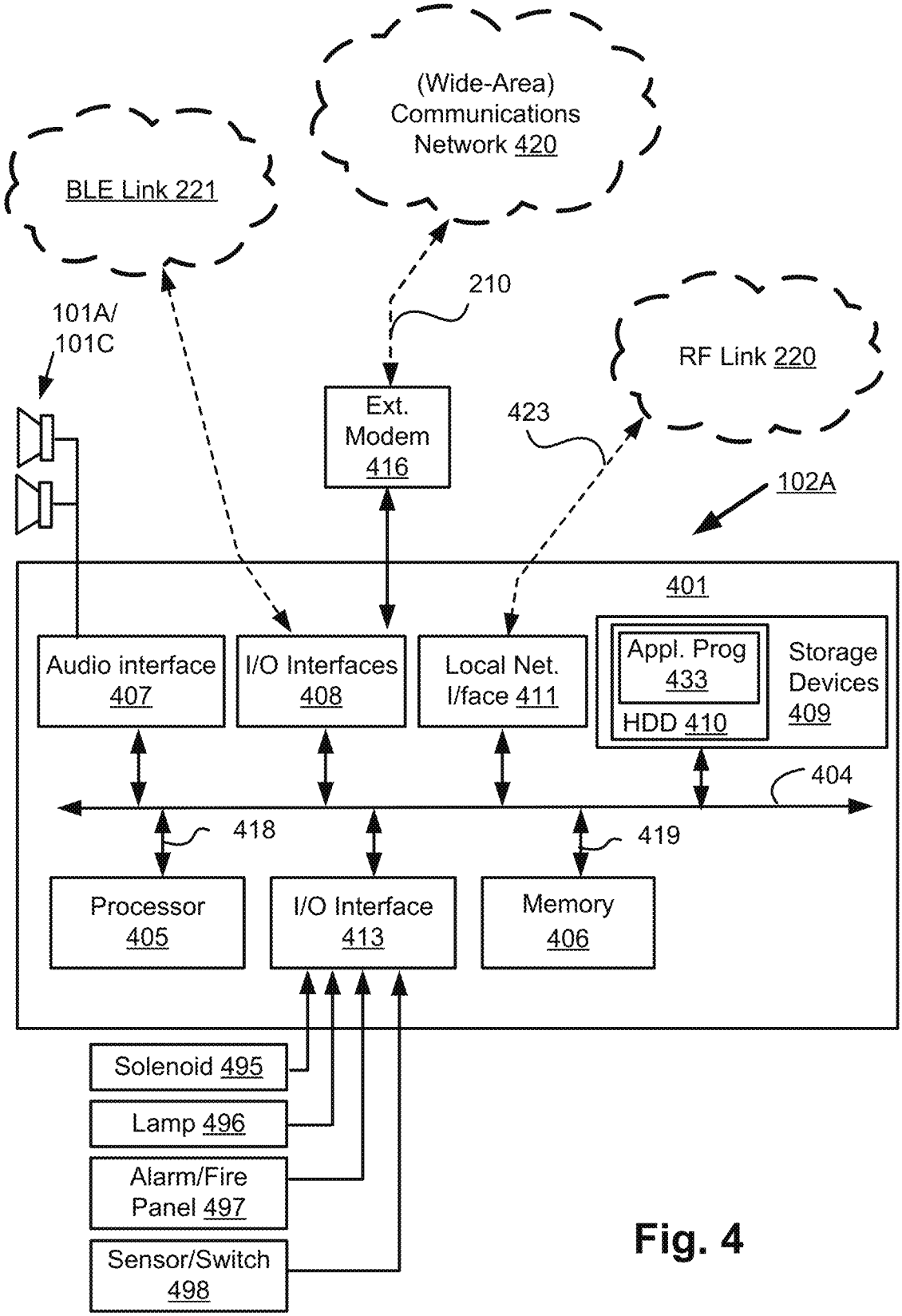
FIG. 4 is a schematic block diagram of a computer system upon which the control modules described can be practiced.

FIGS. 4A and 4B depict a computer system forming the control module 102A, upon which the various arrangements described can be practiced. The control modules 102B and 102C have a similar configuration to the control module 102A.

As seen in FIG. 4A, the control module 102A includes a module 401. The control module 102A is connected to the speaker 101A. An external Modulator-Demodulator (Modem) device 416 may be used by the module 401 for communicating to and from the communications network 420 via link 210. The communications network 420 may be a wide-area network (WAN), such as the Internet, a cellular telecommunications network, or a private WAN. In one arrangement, a wireless modem may also be used for wireless connection to the communications network 420. In another arrangement, the link 210 is a telephone line and the modem 416 may be a traditional "dial-up" modem. In another arrangement, the link 210 is a WIFI interface to LAN internet gateway. Alternatively, where the link 210 is a high capacity (e.g., cable) connection, the modem 416 may be a broadband modem.

The module 401 typically includes at least one processor unit 405, and a memory unit 406. For example, the memory unit 406 may have semiconductor random access memory (RAM) and semiconductor read only memory (ROM). The module 401 also includes a number of input/output (I/O) interfaces including: an audio interface 407 that couples to the loudspeaker 101; an I/O interface 413 that couples to input devices (e.g., a keyboard) and output devices (e.g., an electromechanical device (a lock solenoid) 495, lamp 496, motor (not shown) or third party fire/alarm control panels 497 and/or sensor/switch); and an interface 408 for the external modem 416. In some implementations, the modem 416 may be incorporated within the module 401, for example within the interface 408. The module 401 also has an RF local network interface 411, which permits coupling of the control module 102A, via link 423, to the radio link 220. In the example of FIGS. 1 to 4B, the local network interface 411 comprises an RF transceiver. In other embodiments, the local network interface 411 may comprise an Ethernet circuit card, a Bluetooth® wireless arrangement or an IEEE 802.11 wireless arrangement; however, numerous other types of interfaces including wired Ethernet may be practiced for the interface 411.

The I/O interfaces 408 and 413 may afford either or both of serial and parallel connectivity, the former typically being implemented according to the Universal Serial Bus (USB) standards and having corresponding USB connectors (not illustrated). Alternatively, the I/O interfaces 408 and 413 may comply with the RS232 or RS485 standards. In still another arrangement, the I/O interfaces 408 and 413 may provide Bluetooth connectivity. Storage devices 409 are provided and typically include a hard disk drive (HDD) 410. Alternatively, the storage devices 409 may include Flash and non-volatile memory devices (not illustrated), SD cards. Other storage devices such as USB drives (not illustrated) may also be used. Portable memory devices, such as USB-RAM, portable external hard drives, and SD cards, for example, may be used as appropriate sources of data to the control module 102A. Cloud storage accessed via the network 420 may also be used as appropriate sources of data to the control module 102A.

The components 405 to 413 of the module 401 typically communicate via an interconnected bus 404. For example, the processor 405 is coupled to the system bus 404 using a connection 418. Likewise, the memory 406 and storage devices 409 are coupled to the system bus 404 by connections 419.

One or more of the methods described below may be implemented using the control module 102A wherein the processes to be described, may be implemented as one or more software application programs 433 executable within the control module 102A. In particular, the steps of the described methods are affected by instructions in the software 433 that are carried out within the control module 102A. The software instructions may be formed as one or more code modules, each for performing one or more particular tasks.

The software may also be divided into two separate parts, in which a first part and the corresponding code modules performs the described methods and a second part and the corresponding code modules manage a user interface between the first part and the user.

The software may be stored in a computer readable medium, including the storage devices described below, for example. The software 433 is typically stored in the ROM or the memory 406.

The software is loaded into the control module 102A from the computer readable medium, and is then executed by the control module 102A. A computer readable medium having such software or computer program recorded on the computer readable medium is a computer program product. The use of the computer program product in the control module 102A preferably effects an advantageous apparatus for implementing the described methods.

In some instances, the application programs 433 may be supplied to the user encoded on one or more USB drives (not illustrated) and read via the corresponding drive 412, or alternatively may be read by the user from the networks 420 or 220. Computer readable storage media refers to any nontransitory tangible storage medium that provides recorded instructions and/or data for execution and/or processing. Examples of such storage media include SD cards, DVD, Blu-Ray™ Disc, a hard disk drive, a ROM or integrated circuit, USB memory, a magneto-optical disk, or a computer readable card such as a PCMCIA card and the like, whether or not such devices are internal or external of the module 401. Examples of transitory or non-tangible computer readable transmission media that may also participate in the provision of software, application programs, instructions and/or data to the module 401 include radio or infra-red transmission channels as well as a network connection to another computer or networked device, and the Internet or Intranets including e-mail transmissions and information recorded on Websites and the like.

The second part of the application programs 433 and the corresponding code modules mentioned above may be executed to implement one or more graphical user interfaces (GUIs) to be rendered or otherwise represented. Through manipulation of typically a touch screen, a user may manipulate the interface in a functionally adaptable manner to provide controlling commands and/or input to the applications associated with the GUI(s). Other forms of functionally adaptable user interfaces may also be implemented, such as an audio interface utilizing speech prompts output via the loudspeaker 101A.

The described methods may alternatively be implemented in dedicated hardware such as one or more integrated circuits performing the functions or sub functions of the described methods. Such dedicated hardware may include graphic processors, digital signal processors, or one or more microprocessors and associated memories. In one arrangement, the control modules 102A-102C may be implemented in an 8-bit microprocessor or the like.

The remote-control units 103 and 106 have a similar configuration to the control module 102A. The remote-control units 103 and 106 include at least one processor unit, and a memory unit. For example, the memory unit of the remote-control units 103 and 106 may have semiconductor random access memory (RAM) and semiconductor read only memory (ROM). Again, one or more of the methods described below may be implemented using the remote-control units 103 and/or 106 wherein the processes to be described, may be implemented as one or more software application programs executable within the remote-control units 103 and/or 106. In particular, the steps of one or more of the described methods are effected by instructions in the software that are carried out within the remote-control unit 103 in a similar manner to the control module 102A.

Similarly, each beacon 105A-105B has a similar configuration to the control module 102A. Each beacon 105A-105B includes at least one processor unit, and a memory unit. The memory unit of the beacons 105A-105B may have semiconductor random access memory (RAM) and semiconductor read only memory (ROM). Again, one or more of the methods described below may be implemented using a beacon (e.g., 105A) wherein the processes to be described, may be implemented as one or more software application programs executable within the beacon 105A. In particular, the steps of one or more of the described methods are effected by instructions in the software that are carried out within the beacon 105A in a similar manner to the control module 102A.

As described above, one of the control modules (e.g., 102A) may function as a 'system control module (SCM)', where the control module 102A is used for collecting and storing and logging status and other messages within RAM of the storage device 409. The control module 102A may also be used to determine the physical location of the remote-control unit 103 from supplied network data and provide location and man-down trigger decisions as described below. In one arrangement, the control module 102A may only be capable of full location and logging functionality while a companion application device is paired to the control module 102A. Screen interface and advanced logging is essentially an integrated companion application device.

The remote-control units 103 and 106 are configured to provide feedback status (e.g., batter health and location information), under execution of the processor of the remote-control units 103 or 106A, to one or more of the control modules 102A-102C. The status information may be used to allow battery replacement/charging to be scheduled as needed and to reduce battery wastage due to unnecessary maintenance. The remote-control units 103 and 106 typically sleep in low power mode and periodically wakes-up to listen for signals from a beacon (e.g., 105A) or control module (e.g., 102A). The remote-control units 103 and 106 periodically transmit status information to one or more of the control modules 102A-102C, possibly via a repeater (e.g., 105A) depending on the location of the remote-control unit 103 and 106. Upon transmitting the status information, the remote-control units 103 or 106, under execution of the corresponding processor of the remote-control unit 103/106, waits for a receipt reply from at least one of the control modules 102A-102C and/or repeaters 104A-104B.

The repeaters 104A-104B, under execution of their internal processors, listen for network transmissions and respond to commands (e.g., send signal to control to trigger alert). The repeaters 104A-104B may also be configured to periodically transmit signals (i.e., including a corresponding repeater identifier (ID)) to the controllers 102A-102C to announce presence of the repeaters 104A-104B to the system 100.

In one arrangement, the beacons 105A-105B differ from the control modules 102A-102B and repeaters 104A-104B in that the beacons 105A-105B are small battery powered devices with long (>1 year) battery life. The beacons 105A-105B, under execution of their internal processors, listen for network transmissions and respond to commands (e.g., send transmission signal to control to trigger alert). The beacons 105A-105B may also be configured to periodically transmit signals (i.e., including a corresponding beacon identifier (ID)), to the controllers 102A—102C to announce presence of the beacons 105A-105B to the system 100. Periodically the beacons 105A-105B may perform a re-transmission (e.g., every ten (10) seconds) to await a clock synchronization update or command to enter a configuration mode where the beacons 105A-105B can receive instructions to reconfigure settings.

Transmission power used by the beacons 105A-105B is configurable, with lower power reducing the radius of beacon reception for a more contained location radius. For example, to contain the signal radius of a beacon 105A to one room, signal penetration through walls may be minimized. Further, to limit the signal radius of a beacon to a workstation or the like even lower transmission power may be used so that the signal transmitted by a beacon 105A is as short as one (1) meter.

While radius of the radio transmission of the beacon 105A can be narrowed down with signal strength, a higher transmission power uses more battery so the transmission power of the beacons 105A-105B is not set more powerfully than is necessary for the beacons 105A-105B intended range.

The beacons 105A-105B may use a primary radio protocol, or a secondary Bluetooth radio protocol which may require the remote-control unit 103 to be fitted with a dual radio option.

Listening for the beacons 105A-105B is battery intensive since the remote-control unit 103 or 106 needs to spend long periods with a receive radio mode activated. Therefore, the remote-control units 103 and 106 may be configured to only refresh a beacon positioning on a slow schedule (e.g., every thirty (30) seconds. However, the remote-control units 103 and 106 may be configured in some implementations to use higher refresh rates as desired. For example, if the remote-control unit 103 is mounted on a moving forklift with location tracking, both the remote-control unit 103 and beacons 105A-105B may poll multiple times per second.

In one arrangement, the remote-control units 103/106 and beacons 105A-105B utilize clock synchronization to allocate time slots for transmission events so that radio receive power is not wasted listening during sleep slots.

Figure 6:
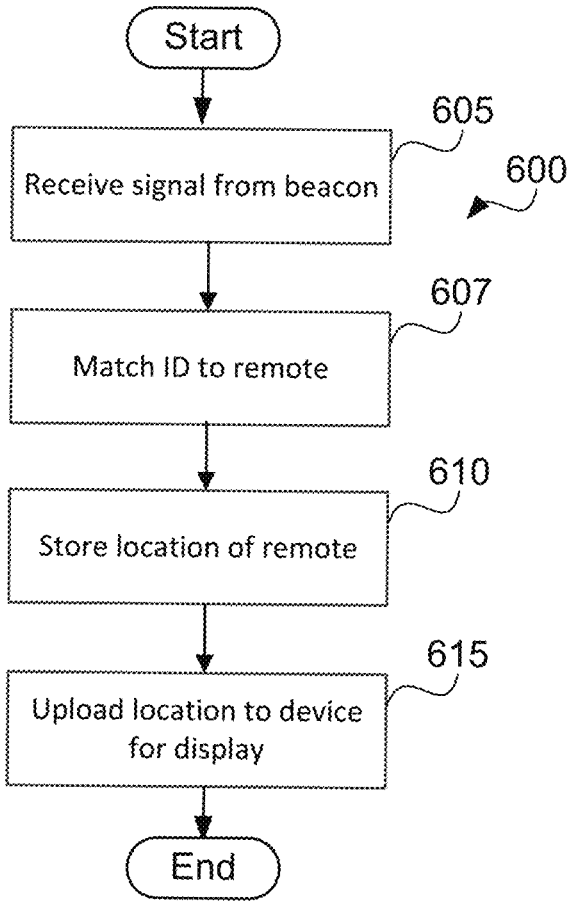
FIG. 6 is a flow diagram showing a method of determining the location of the remote-control of FIG. 1.

A method 600 of determining the location of the remote-control unit 103 will now be described with reference to FIG. 6. The method 600 may be similarly used to determine the location of the remote-control unit 106.

The method 600 may be implemented as one or more software applications resident in the storage devices 409 of the control module 102A and being controlled in its execution by the processor 405. However, in other arrangements the control modules 102B-102C may also be used to execute the described methods as one or more software applications resident in the storage devices of the control modules 102B-102C. In still other arrangements, any of the repeaters 104A-104B, beacons 105A-105B or the device 230 may be used to execute the methods as one or more software applications resident in storage devices of those repeaters 104A-104B, beacons 105A-105B or the device 230.

The method 600 may be executed upon an emergency alert being triggered by a user using the remote 103.

The method 600 begins as step 605 where the control module 101A, under execution of the processor 405, receives a transmission signal from a beacon (e.g., 105A), via the radio link 220 and RF local network interface 411. The transmission signal includes an identifier (ID) for the beacon (e.g., 105A) that transmitted the signal. The transmission signal may further include a signal strength value indicating the signal strength of a transmission signal received from the remote 103 by the beacon 105A.

Then at step 607, the processor 405 matches the ID in the received transmission signal to a database of beacon identifiers stored within the storage 409 of the control module 102A to identify the beacon 105A-105B that transmitted the signal and to determine the physical location of that beacon. The database of beacon identifiers includes the physical location of the beacons 105A-105B (e.g., as positioning system (GPS) coordinate or physical address) on the site (e.g., school) on which the system 100 is installed. In one arrangement, the database of beacon identifiers may be stored within the storage of the device 230 or CMC and the device 230 or CMC may be used to match the ID in the received transmission signal.

At the next step 610, the processor 405 of the control module 101A stores the location of the beacon 105A as the location of the remote-control unit 103. The signal strength value received in the transmission signal received by the control module 101A at step 605 may be used to improve the precision of the location of the remote 103. For example, the control module 101A may determine that the remote 103 is within one (1) meter of the beacon 105A based on the signal strength of the received transmission signal.

Figure 5:
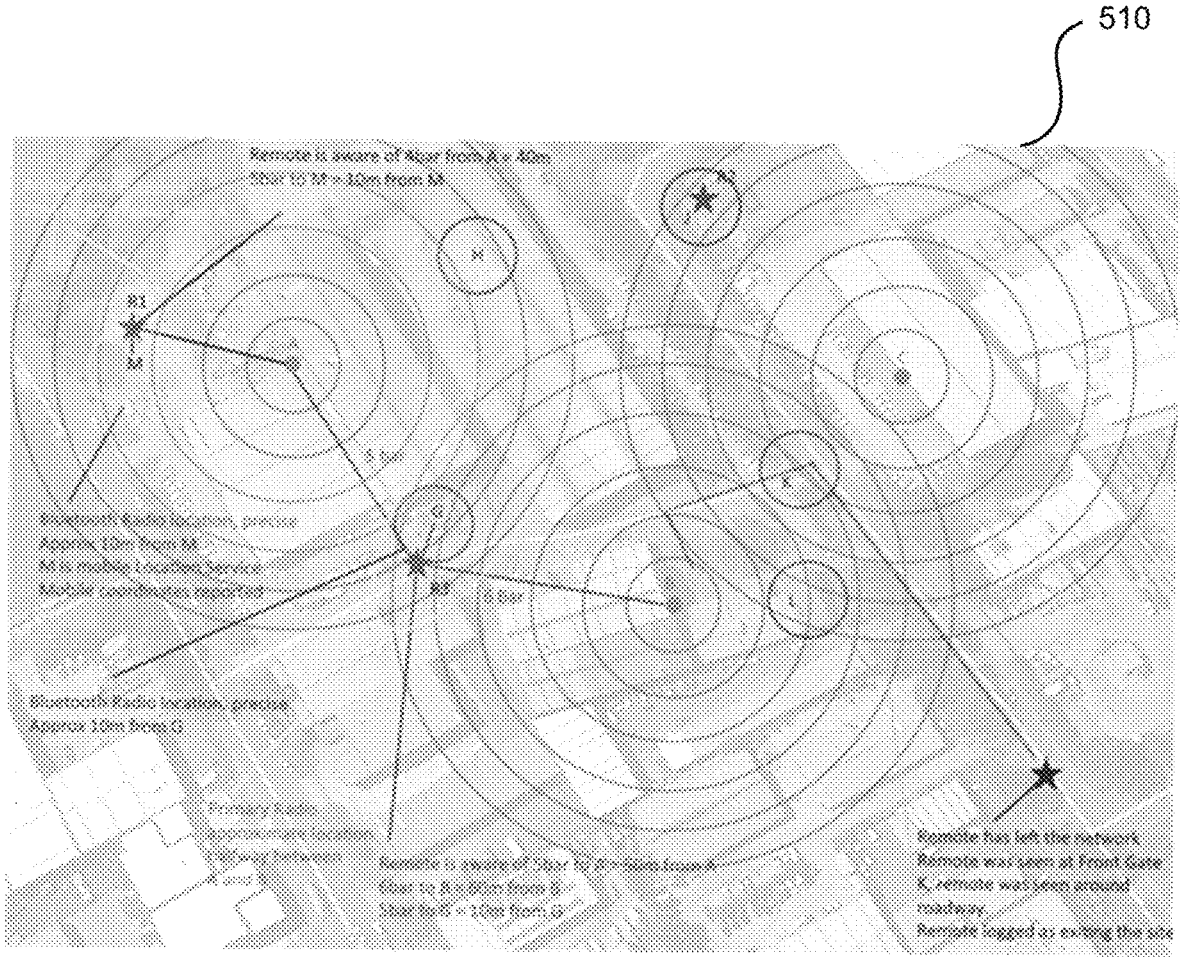
FIG. 5 shows a user interface for use with the system of FIG. 1.

Then at the next step 615, the processor 405 of the control module 102A uploads the stored location, via the link 220 and/or BLE link 221, for display on the device 230. The location may be a zone or multiple zones, where location accuracy is represented on a display of the device 230 as varying radius circles. For example, the location of the remote-control unit 103 may be indicated on a user interface 510, as seen in FIG. 5, displayed on a display of the device 230. FIG. 5 shows the interface 510 including an image of the site that the emergency alert system 100 has been installed. In the example of FIG. 5, various remotes R1, R2 and R3 are displayed within radio range of multiple control modules A, B, C and beacons H, G, K and L. More beacons located at key points within a site improve location precision.

Determining the location of the remote 103 using the beacons 105A-105B in accordance with the method 600 as described above is advantageous as the signal from a beacon (e.g., 105A) provides a reasonably accurate indication of the location of the remote 103. The presence of the beacons 105A-105B greatly enhances accuracy of the determined location of the remote 103 since the beacons 105A-105B operate over a smaller signal radius so the presence of the beacons 105A-105B narrows down location to a smaller more precise area less effected by signal obstructions.

As described above, signal strength may be used to narrow down the radius of the remote-control unit 103 from a beacon 105A for even more precision. In this regard, short-range radio signals typically do not extend beyond ten (10) meters and are typically heavily attenuated by solid objects. Short-range radio signals will also typically not penetrate walls. As such, the beacons 105A-105B being short-range may be used within a single room or at a workstation to provide a reference at a particular location within the site on which the system 100 is installed. If the remote control unit 103 is within radio signal range of one of the short-range beacons (e.g., 105A), then it can be assumed that the remote control unit 103 is within the same room as that short-range beacon 105A.

The location of the remote-control unit 103 may be determined using strength of signals from the remote-control unit 103 to the repeaters 104A-104B, control modules 102A-102C and the beacons 105A-105B. In one arrangement, signal strength information is relayed back to the control module 102A which processes available data with repeater/beacon locations, location history and site survey data to determine possible locations of the remote 103 within the accuracy of the data available.

The site survey data may be determined prior to execution of the method 600 and be stored in a site survey databased configured within the storage 409 of the control module 102A. The site survey data provides improved location accuracy as site survey data compensates for uneven signal distribution. In relation to site survey data, simple signal strength and triangulation is effective in an empty field with clear line of sight. However, radio signals are obstructed amongst buildings such that locations closer to a radio transmitter may have weaker signals than other locations further from the transmitter. The site survey data creates a reference database for such varying signal strengths which can be cross referenced when determining location of the remote-control unit 103. The predetermined site survey data stored within the control module 102A, for example, may be amended whenever a GNSS equipped remote-control unit (e.g., 103) or companion application device (e.g., 230) is used within the implementation site so that the site survey data stored in site survey database data may be adjusted over time.

A site survey map overlay (e.g., displayed on the device 230) may be used to visually highlight areas which lack site survey data. Such a site survey map may also be used to perform self testing on survey points to highlight locations, where survey results are ambiguous. Therefore, more survey readings or a short-range beacon (e.g., 105A) may be added at such highlighted locations.

The repeaters 104A-104B and control modules 102A-102C log contacts with the remote-control units 103 and 106 over a period of time and forward signal strength information, via the link 220, back to the control module 102A which stores the signal strength information in the storage 409. Further, the remote-control units 103 and 106 may report a table of signals received from the repeaters/beacons recently received and their signal strength and forwards the signal strength information via the links 220 and/or 221 back to the control module 102A.

Previously determined site survey data may be cross referenced with the table of signals provided by the remote-control units 103 and 106 to enable the control module 102A to account for areas of weak/irregular signals and make a more accurate determination of the location of the remote-control units 103 and 106 when no short-range beacon 105A-105B is present.

In one arrangement, location history combined with assumptions of maximum movement speed and impassable obstructions may be used to determine the location of the remote-control unit 103 or 106 and to eliminate possible path of travel in order to eliminate many cases of multiple possible positions.

In one arrangement, the remote-control units 103 and 106 periodically poll for beacons 105A-105B within range of the remote-control units 103/106 and store a table in memory of the remote-control units 103 and 106. The stored table references the identifier (ID) of the beacon (e.g., 105A), signal strength, and time since contact with the beacon 105A. Additionally, beacon status such as battery percentage may be collected by the remote-control units 103 and 106 for forwarding to the control module 102A for storage as status logs. Table entries stored within the remote-control unit 103, for example, are cleared when the remote-control unit 103 has uploaded the table entries to the system 100 via the radio link 220. In the event of memory capacity of the remote-control units 103 or 106 becoming full, weaker signal scores (i.e., taking into account the signal strength versus beacon transmission strength) may be overwritten by higher signal scores as higher signal scores are more valuable to position determination.

The remote-control units 103 and 106 upload the tables to the control module 102A, via the repeaters 105A-105B, during periodic status transmissions. Such uploads may include an acknowledgement component to ensure data has been passed onto the control module 102A successfully.

The repeaters 105A-105B are configured to poll for remote control units (e.g., 103) sending status (and alarm trigger) transmissions. The repeaters 105A-105B store any uploaded table from the remote-control unit 103 or 106 in the memory of the repeater 105A-105B referencing the identifier (ID) of the remote-control unit 103 or 106, signal strength, and time since contact. A repeater 105-105B may negotiate with the remote-control unit 103 or 106 to route the beacon table and status information to the control module 102A via the radio link 220 and/or BLE link 221. The repeaters 105A-105B, under execution of a processor within the repeaters 105A-105B, route the beacon\remote contact tables to the control module 102A, via the link 220.

Figure 7:
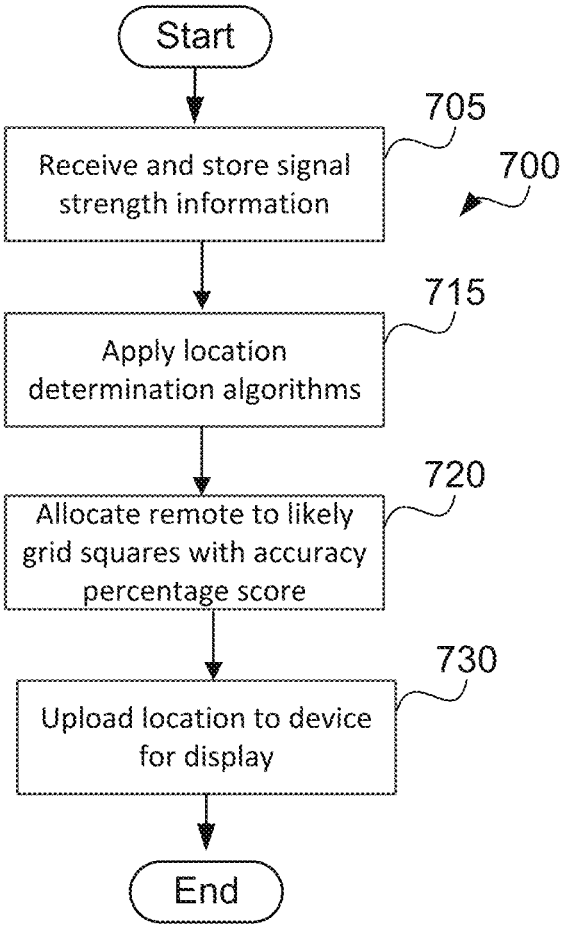
FIG. 7 is a flow diagram showing another method of determining the location of the remote-control of FIG. 1.

Another method 700 of determining the location of the remote 103 will now be described with reference to FIG. 7. The method 700 may be similarly used to determine the location of the remote-control unit 106.

The method 700 may be implemented as one or more software applications resident in the storage devices 409 of the control module 102A and being controlled in its execution by the processor 405. However, in other arrangements the control modules 102B-102C may also be used to execute the method 700 as one or more software applications resident in the storage devices of the control modules 102B-102C. In still other arrangements, any of the repeaters 104A-104B, beacons 105A-105B or the device 230 may be used to execute the method 700 as one or more software applications resident in storage devices of those repeaters 104A-104B, beacons 105A-105B or the device 230.

The method 700 may use predetermined site survey data, as described above, for the site on which the emergency alert system 100 is implemented. In one arrangement, prior to execution of the method 700, a site survey may be conducted with the remote-control unit 103 paired with a companion application executing on the device 230 where the device 230 has global positioning system (GPS) or similar (e.g., GLObal NAvigation Satellite System (GLONASS), Galileo, Global Navigation Satellite System (GNSS)) capability. The site survey data may be used to enhance positioning accuracy. All areas of the site on which the system 100 is installed may be traversed using the remote-control unit 103 and device 230 to gather RF signals at various locations of the site. The gathered site survey data may be stored in a database of the storage module 409 of the control module 102A. The site survey data stored in the storage 409 of the control module 102A may be updated over time by a pairing of the companion application executing on the device 230 as described above.

In one arrangement, the database of site survey data may be converted to a simplified grid with each grid square referencing approximate signal scores expected at a location. The grid may then be overlaid with an aerial or virtual image of the site for easy viewing and reference. The grid may be determined prior to execution of the method 700 and then be stored within the storage module 409 of the control unit 102A. Elements may be "drawn" on the overlay to specify impassable walls which will help location algorithms eliminate impossible/improbable paths of physical movement. The beacons 105A-105B and repeaters 104A-104B may be positioned on the map to assist with positioning. Indoor beacons may be included on the map, where GPS cannot provide an accurate position for the survey readings.

In one arrangement, the remote-control units 103 and 106 may provide beacon/repeater contact information direct to a companion application executing on the device 203, where the companion application logs contacts and other data (e.g., status data) to an application database.

The method 700 may be executed upon an emergency alert being triggered by a user using the remote-control unit 103.

The method 700 begins at step 705, where the control module 102A receives any signal strength information, together with identifiers for the remote-control unit 103 and time since contact information, from the repeaters 104A-104B and stores the received information in storage 409.

In one arrangement, the control module 102A, under execution of the processor 405, cross references the signal information, identifiers for the remote-control unit 103 and time since contact information received at step 705 with any site survey data stored in storage 409 of the module 102A to account for areas of weak/irregular signals.

At step 715, the control module 102A, under execution of the processor 405, applies location determination algorithms to the contact and status information stored within the control module 102A in order to narrow down a location radius for the remote-control unit 103. In the case of the remote-control unit 103 being close to one the short-range beacons 105A-105B, the algorithm applied at step 715 may be to declare that the remote-control unit 103 is at or near the physical location of the beacon (e.g., 105A), as in the method 600, and other processing is unnecessary.

In one arrangement, primary radio signals from the control modules 102A-102C may be used to determine a location of the remote-control unit 103 when the remote-control unit 103 is within an overlap of the multiple control modules 102A-102C. A radio signal strength algorithm may be used to triangulate approximate position of the remote-control unit 103 to each of the control modules 102A-102C (or repeaters 104A-104B). Primary radio signals from the control modules 102A-102C may be used to provide a high-level indication of the location of the remote-control unit 103 with reference to the control modules 102A-102C. The high-level location may be narrowed down to overlapping radio signal regions if the remote-control unit 103 is within an overlap region of the radio signals being transmitted by the control modules 102A-102C.

Similar radio signal strength algorithms may be executed at step 715 in relation to the beacons 105A-105B to enhance location resolution. The beacons 105A-105B provide a small location reference point if the remote-control unit 103 is within signal range of a beacon (e.g., 105A). In one arrangement, a beacon 105A may comprise a GPS chipset allowing a precise location of the remote-control unit 103 to be reported to the control module 102A.

Then at step 720, the control module 102A, under execution of the processor 405, allocates the remote-control unit 103 to one of the predetermined grid squares of the predetermined grid stored in the storage 409 of the control module 102A in order to determine the location of the remote-control unit 103. For example, a grid comprising squares of predetermined size (e.g., 5 metre×5 metre) may be laid out over the site (e.g., a school) in which the system 100 is installed. An accuracy percentage score may be determined for each of the grid squares of the grid. In regard to the grid, in one arrangement, the site survey data contains the signal strength readings of all fixed position transmitter devices which were received within each grid block. At step 720, live radio signal readings from the remote-control unit 103 may be compared to each surveyed grid square to determine which is the closest match. In one arrangement, the comparison may be performed with a point score system where the difference between the site survey data and live reading received signal strength indication (RSSI) is scaled by an adjustment factor which is added to create a score for each grid square. The grid with the lowest score is most likely to be the matching grid.

Further, elimination of unlikely locations for the remote-control unit 103 with reference to a grid square may be achieved by including a score for each grid square based on proximity to previous locations of the remote-control unit 103. For example, normal movement of the remote-control unit 103 around the site traverses through adjoining grids and cannot teleport across multiple grids instantly.

In one arrangement, scores determined at step 720 for the predetermined grid squares may be averaged over time such that sporadic anomalies in signal strength are filtered out with the true position of the remote-control unit 103 dominating the score.

In one arrangement, the comparison of the live radio signal readings from the remote-control unit 103 to each surveyed grid square, takes into account that some radio signal transmitters on the site (e.g., repeaters 104A-104B, beacons 105A-105B) may be offline or have changed their parameters since the site survey data was gathered. Where multiple possibilities exist for the location of the remote-control unit 103 in relation to one of the grid squares, determined scores may be converted to a percentage and the determined percentage may be conveyed to the user (e.g., via the device 230).

At step 730, the processor 405 of the control module 101A uploads the location determined at step 720 to the device 230, via the link 220, for display (e.g., on the user interface 510) on the device 230.

In one arrangement, the remote-control units (e.g., 103) and system 100 may be configured to detect a lack of movement and/or lack of button interaction. In the event of such a lack of movement and/or lack of button interaction, a notification/alert referred to as a "man-down alert" may be generated by the control module 102A, for example, to indicate that investigation is needed in order to determine if a critical lookout or user is incapacitated (i.e., there is a man-down). The lack of movement of the remote-control unit 103 may be determined using piezo accelerometers configured within the remote-control unit 103. Failure to meet a movement threshold may set an "immobile flag" in a status transmission sent by the remote-control unit 103, via the radio link 220, to the control module 102A. The remote-control unit 103 may report the immobile flag in periodic status transmissions sent by the remote 103 to the control module 102A. The processor within the remote-control unit 103 may poll the accelerometers periodically to determine movement state, where the rate of polling is dynamic based on network configuration flags for the remote-control unit 103. Reduced polling of the accelerometers may be performed when the remote-control unit 103 is sitting idle already in an immobile state. Reduced or no polling of the accelerometers may be performed, or the man-down alarm may be disabled if the location of the remote-control unit 103 is identified as in a home location (e.g., in an office).

In one arrangement, a man-down alert may be generated by the control module 102A in the absence of a user selecting one of the buttons 301-305 on the remote-control unit 103 for a predetermined period of time or when prompted by an audio/visual alert. Similarly, a man-down alert may be
generated by the control module 102A in the absence of a user selecting one of the buttons (e.g., 301-305) on the remote-control unit 106 for a predetermined period of time or when prompted by an audio/visual alert.

As described above, the remote-control unit 103 may be used to provide a "man down" alert, triggered by absence of interaction or physical movement of the remote-control unit 103 for a predetermined period of time. The absence of interaction or physical movement of the remote-control unit 103 for a predetermined period of time may set a "flag" within a status of the remote-control unit 103 indicating the unit is immobile. Upon receiving the status transmission sent by the remote-control unit 103, the control module 102A may trigger an alert. The immobile flag may be processed by the control module 102A which silently displays the status. However, the control module 102A may be configured to raise varying levels of alert triggers in response to a set immobile flag being received by the control module 102A. The control module 102A may be configured to respond to the immobile flag as applicable to a current configuration of the control module 102A. The levels of alert triggers may include i) a local beep at the control panel 102A; ii) a notification being sent to the companion application executing on the device 230; iii) a local area alarm trigger where the control panel 102A causes an alarm to be sounded by the siren 101A but not alarm at the other control panels 102B and 102C; iv) a system wide alarm trigger where all of the sirens 101A-101C sound an alarm; v) no action: where the man-down alert is disabled or ignored and vi) silent status, where a set immobile flag does not trigger anything on the system 100 (e.g., the immobile flag may be used to determine if a user of the remote-control unit 103 is lazy and not actively patrolling the site).

In one arrangement, the remote-control unit 103 may be configured, via the control module 102A, to provide a visual alert (e.g., via a light emitting diode 306), audio alert (e.g., via audio beeper (not shown) configured within the unit 103) or vibration alert (e.g., via a vibration motor (not shown) configured within the unit 103) to the user in response to the remote-control unit 103 entering an immobile state. Such a visual, audio or vibration alert provides a chance for the user of the remote-control unit 103 to avoid a man-down alert from triggering when the user is consciously immobile (e.g., working at a desk). The control module 102A or the companion application executing on the device 230 may configure the remote-control unit 103 to enable such man-down alerts.

If the man-down alerts are enabled, the remote-control unit 103 may trigger an internal alert for a short period when about to transition from moving to immobile. Movement or pressing cancel button 305, for example, may restart a timeout. If the remote-control unit 103 remains immobile then the immobile flag will be set.

As described above, the remote-control units 103 and 106 may be configured to provide location functionality similar to a location beacon (e.g., 105A). In one arrangement, the remote-control units 103 and 106 may comprise a GPS chipset or similar system (e.g., GLObal NAvigation Satellite System (GLONASS), Galileo, Global Navigation Satellite System (GNSS)) configured within the unit 103 to provide inbuilt GPS positioning.

In one arrangement, the GPS chipset may be paired with the companion application executing on the device 230. A remote-control unit (e.g., 103) comprising a GPS chipset is able to act as a short-range beacon similar to the beacons 105A-105B. The remote-control units 103 and 106 may be configured to upload GPS coordinates provided by such a GPS chipset to the control module 102A, via the radio link 220, for use in determining the location of the remote-control units 103 and 106. The control module 102A may poll the GPS chipset, via the radio link 220, periodically to determine the GPS coordinates of the remote-control unit 103 or 106. In such an arrangement, the GPS chipset is acting as an inbuilt positioning service sensor. The GPS coordinates may be reported to the control module 102A, via the link 220, within performance constraints of the system 100.

In one arrangement, a remote-control unit 103 comprising a GPS chipset may be fitted in a vehicle or the like. Accelerometers fitted in a remote-control unit 103 with a GPS chipset may be used to place the GPS chipset in a sleep state when the remote-control unit 103 is not moving. The remote-control unit 103 may be configured to pack GPS coordinate data into periodic status transmissions to the control module 102A via the link 220.

As described above, in one arrangement, the remote-control unit 103 may be configured with a BLE (Bluetooth Low Energy) chipset. The remote control unit 103 fitted with a BLE chipset may be configured to pair (i.e., link) with the companion application executing on the device 230. Such BLE pairing may be established as per an Android™/iOS application program interface (API). The companion application executing on the device 230 may be configured to determine coordinates as per the API where coordinates are exchanged between the companion application and the remote 103 via BLE protocol. The remote-control unit 103 may be configured to pack coordinate data into a periodic status transmission to the control module 102A via the link 220.

In one arrangement, the location of the remote-control unit 103 may be tracked live using the companion application executing on the device 230, so as to serve an additional tracking device capability unique to site alert systems. In such an arrangement, the location of the remote-control unit 103 may be determined as described above and be streamed for a period of time to the control module 102A and/or the device 230 via the RF link 220. The companion application may be used for displaying the location of the remote-control unit 103 on an image of the site using the user interface 510, for example, as seen in FIG. 5. Such live tracking of the location of the remote-control unit 103 may be used for monitoring visitor/staff location on a site and for ensuring personnel carrying the remote-control unit 103 have moved to a safe evacuation area in the event of an emergency. The live tracking may also be used to direct rescue efforts to the location of the remote-control unit 103 on the site if the personnel carrying the remote-control unit 103 has not evacuated (e.g., the personnel may be trapped or unable to respond to evacuation). Location history of the remote control unit 103 stored within the control module 102A, for example, may be used to determine the final movements of the remote-control unit 103 to determine if the remote-control unit 103 was removed from the site.

The BLE chipset configured within the remote-control unit 103 or 106 may be used to pair with the device 230 executing the companion application. The remote-control unit 103 or 106 provides a gateway between the device 230 and the communications protocol being used by the system 100. Account login permissions may be utilized to restrict user powers (e.g., basic user versus admin user). The pairing of the remote-control unit 103 or 106 with the companion application allows for a much more advanced interface compared with existing systems. Remote location and man-down status may be viewed using the companion application. The companion application executing on the device 230 may be used to view the status of the system 100. Alerts unavailable to the physical buttons 301-305 may be triggered in one or more software code modules forming the companion application being executed on the device 230. Individual inputs/outputs may be triggered using the companion application.

Software application programs executing on the remote-control units 103 and 106 may be configured as a gateway to link and convert protocols so that the companion application executing on the device 230 can communicate as part of the system 100. In this regard, a Bluetooth link between the remote-control unit 103, for example, and the companion application executing on the device 230 may be used to provide a translated protocol link between the paired device 230 and the companion application. Such a protocol link removes security, checksums and binary encoding, manages radio timing and connection attempts such that the companion application executing on the device 230 only needs to communicate with ASCII command strings. The protocol link also reduces the complexity of the companion application side coding. Further, the protocol link may be used to secure the proprietary details of the protocol to the companion application executing on the device 230 which has the advantage of allowing third parties to interface to the system 100 without compromising security of the system 100.

The companion application executing on the device 230 may programmed so as to emulate and perform the location processing of any of the physical devices of the system 100 including the control module 102A within the system 100 and thus perform all functions of the control module 102A. For example, the companion application executing on the device 230 may be configured to gather all status logs, change system configuration, trigger alerts, page the remote-control unit 103 as well as send software application specific commands such as a text message to another software application executing on another device similar to the device 230.

Access to functions of the system 100 may be password login protected with varying security privileges, such that a standard login cannot change configuration or view log history.

The companion application executing on the device 230 may be used for reconfiguring the system 100 such as turning one or more of the control modules 102A-102C on or off. The companion application may also be configured to send text messages to other paired devices via the link 220 independent of cell/internet availability.

In one arrangement, the companion application executing on the device 230 may also be used to send text messages to variable message (VMS) signs connected to the link 220. Further, the control modules 102A-102C may comprise an RS232 interface or the like which can interface with such a VMC sign. A VMS message may be displayed on the sign to show text messages for each triggered alert, or to display custom messages sent by the companion application, via the link 220 independent of the communications network 420. Evacuation messages may also be tailored to specify to evacuate away from the trigger location.

The companion application executing on the device 230 may be used for transmitting a signal, (i.e., a paging signal including an identifier for the remote control 103) to the remote-control unit 103 (or remote-control unit 106) to page the remote-control unit 103 (or remote-control unit 106). Such a transmitted paging signal may also be transmitted to the remote-control unit 103 (or remote-control unit 106) from the control module 102A or any other device (e.g., repeaters 104A-104B, beacons 105A-105B) connected to the link 220. The identifier for the remote-control unit 103 may be targeted to trigger an inbuilt alert output (e.g., light emitting diode, buzzer, vibrator) within the remote-control unit 103 to notify personnel carrying the remote-control unit 103 that their attention is wanted.

In one arrangement, the remote-control unit 103 may be equipped with a vibration motor to allow for an alert to be felt by a user carrying the remote-control unit 103 in loud environments or when hearing impaired. The identifier of the remote-control unit 103 to be paged may be selected via the companion application executing on the device 230, for example.

In one arrangement, paging alerts may be activated for a predetermined period on the remote-control unit 103, or may require the cancel button 305 to be pressed to acknowledge and clear the paging alert. Flags within the paging signal transmitted to the remote-control unit 103 message may specify how the page may be cleared.

In one arrangement, the one or more software applications being executed by the processor configured within the remote-control unit 103 may be configured to detect and process a page signal from the device 230, control module 102A, repeaters 104A-104B or beacons 105A-105B after performing a periodic status check-in with the control module 102A. The software application executed by the processor configured within the remote-control unit 103 may be configured to acknowledge that the remote-control unit 103 has received the paging signal and to send a signal to the device 230 confirming that the paging signal was received successfully.

The software application program being executed by the processor 405 of the control module 102A may be configured to trigger an alert when the control modules 102A detect that the remote-control unit 103 has entered or exited a specific zone within a site. Such zones may be specified based on the range of one of the short-range beacons 105A-105B. For example, when the remote-control unit 103 moves within range of the beacon 105B, the beacon 105 may send a signal to the control module 102A indicating that the remote-control unit 103 has moved within the zone of the beacon 105B. Such zone alerts may be used to notify events such as: Hazardous/prohibited area entered, station unattended, authorized area left.

The control module 102A may comprise an Internet gateway device or execute a software application program to provide internet connectivity, via the communications network 420. The internet connectivity may be used to provide system status and/or to send email logs and alerts.

As described above, the system 100 may be controlled and configured from an external central management control module or the like via the communications network 420 when a link is established between the central management control module and the control module 102A, for example. Health of the system 100 can be reviewed and monitored offsite (e.g., via the device 230 connected to the communications network 420. Email alerts may be generated by software application programs executing on the control module 102A or device 230 and may be addressed to emergency services and offsite administration, via the communications network 420.

In the context of this specification, the word "comprising" means "including principally but not necessarily solely" or "having" or "including", and not "consisting only of". Variations of the word "comprising", such as "comprise" and "comprises" have correspondingly varied meanings.

The invention claimed is:

1. An emergency alert system comprising:

at least one alert device;

a control module physically connected to the alert device for activating the alert device, said control module being configured to receive commands from a central management center over a short range radio link comprising a network of radio beacons; and a portable remote-control unit having a radio transceiver for receiving an emergency signal from the central management center or sending a user activated signal regarding an emergency to the central management center, via the short range radio link, wherein the alert device is separate from the remote-control unit;

a network of repeaters, each repeater having a radio transceiver for relaying information between the portable remote-control unit and the central management center, wherein each radio beacon of the short range radio link is adapted to send periodic short range radio signals to the remote-control unit to determine a location reference for the remote-control unit with respect to each radio beacon, the location reference being communicated to the central management center in the event of the emergency alert being triggered.

2. The system according to claim 1, wherein the physical location of the remote-control unit is indicated on a user interface displayed on a device connected to the radio link.

3. The system according to claim 1, wherein the location of the remote-control unit is tracked live.

4. The system according to claim 1, wherein the system triggers an alert in the absence of physical movement of the remote-control unit for a predetermined period.

5. The system according to claim 1, wherein the system triggers an alert in the absence of a user selection on the remote-control unit for a predetermined period.

6. The system according to claim 1, wherein the central management center is configured for paging the remote-control unit.

7. The system according to claim 1, wherein the system interfaces with the Internet to allow remote monitoring.

8. The system according to claim 1, wherein the location reference is determined independent of a Global Navigation Satellite System (GNSS), a Global Positioning System (GPS), the Internet or any cellular networks.

9. The system according to claim 1, wherein radio signal strength is used to determine the location of the remote-control unit based on triangulation.

10. The method according to claim 1, further comprising one or more strobe lights for providing a visual alert.

11. The method according to claim 1, further comprising one or more repeaters for routing network data from the remote-control unit to the central management center via the short range radio link.

12. The method according to claim 1, wherein the alert device is a speaker.

13. The method according to claim 1, wherein the alert device is a siren.

14. The method according to claim 1, wherein the alert device is an audiovisual device.

15. The method according to claim 1, wherein the radio link is independent of cellular networks and the Internet.

16. An emergency alert system comprising:

at least one alert device;

a control module physically connected to the alert device for activating the alert device, said control module being configured to receive commands from a central management center over a short range radio link; and a portable remote-control unit having a radio transceiver for receiving an emergency signal from the central management center or sending a user activated signal regarding an emergency to the central management center, via the short range radio link, wherein the alert device is separate from the remote-control unit;

a network of repeaters, each repeater having a radio transceiver for relaying information between the portable remote-control unit and the central management center;

a network of radio beacons for determining a physical location of the portable remote-control unit in the event of the emergency alert being triggered, wherein the physical location is determined independent of a Global Navigation Satellite System (GNSS), a Global Positioning System (GPS), the Internet or any cellular networks.

17. The system according to claim 16, wherein the physical location of the remote-control unit is indicated on a user interface displayed on a device connected to the radio link.

18. The system according to claim 16, wherein the location of the remote-control unit is tracked live.

19. The system according to claim 16, wherein the system triggers an alert in the absence of physical movement of the remote-control unit for a predetermined period.

20. The system according to claim 16, wherein the system triggers an alert in the absence of a user selection on the remote-control unit for a predetermined period.

21. The system according to claim 16, wherein the control module is configured for paging the remote-control unit.

* * * * *